US012653243B2

(12) United States Patent
Xie et al.

(10) Patent No.: US 12,653,243 B2
(45) Date of Patent: Jun. 16, 2026

(54) VAPORIZER AND ELECTRONIC VAPORIZATION DEVICE

(71) Applicant: SHENZHEN FIRST UNION TECHNOLOGY CO., LTD., Shenzhen City (CN)

(72) Inventors: Baofeng Xie, Shenzhen City (CN); Linhai Lu, Shenzhen City (CN); Zhongli Xu, Shenzhen City (CN); Yonghai Li, Shenzhen City (CN)

(73) Assignee: SHENZHEN FIRST UNION TECHNOLOGY CO., LTD., Shenzhen City (CN)

( * ) Notice: Subject to any disclaimer, the term of this patent is extended or adjusted under 35 U.S.C. 154(b) by 389 days.

(21) Appl. No.: 18/038,707

(22) PCT Filed: Nov. 17, 2021

(86) PCT No.: PCT/CN2021/131272
§ 371 (c)(1),
(2) Date: May 25, 2023

(87) PCT Pub. No.: WO2022/111358
PCT Pub. Date: Jun. 2, 2022

(65) Prior Publication Data

US 2023/0413915 A1 Dec. 28, 2023

(30) Foreign Application Priority Data

Nov. 25, 2020 (CN) ..... 202011340644.7

(51) Int. Cl.
*A24F 40/485* (2020.01)
*A24F 40/10* (2020.01)
(Continued)

(52) U.S. Cl.
CPC ..... *A24F 40/485* (2020.01); *A24F 40/10* (2020.01); *A24F 40/42* (2020.01)

(58) Field of Classification Search
None
See application file for complete search history.

(56) References Cited

U.S. PATENT DOCUMENTS

2018/0297047 A1 10/2018 Tong

FOREIGN PATENT DOCUMENTS

CN 1199375 A 11/1998
CN 206808661 U 12/2017
(Continued)

OTHER PUBLICATIONS

English machine translation of CN111631437(A) entitled Atomizer and Electronic Atomization Device; Lei et al.; 29 pages; published Sep. 8, 2020; (Year: 2020).*
(Continued)

*Primary Examiner* — Linda L Gray
(74) *Attorney, Agent, or Firm* — Scully, Scott, Murphy & Presser, P.C.

(57) ABSTRACT

A vaporizer and an electronic vaporization device is provided. The vaporizer includes a liquid storage cavity to store a liquid substrate; a seal element partially sealing the liquid storage cavity; a holder to support the seal element to locate the seal element between the holder and the liquid storage cavity; and a first air channel, providing a first flowing path for air to enter the liquid storage cavity, where the first air channel is partially defined by the holder, and has an air outlet end formed on a surface of the holder; the seal element has a blocking part configured to seal the air outlet end; and the blocking part has a free end away from a center of the seal element, and the free end is configured to bend or
(Continued)

deform in response to a negative pressure change in the liquid storage cavity, to open the air outlet end.

20 Claims, 6 Drawing Sheets

(51) Int. Cl.

| | |
|---|---|
| ***A24F 40/42*** | (2020.01) |
| ***A61M 11/02*** | (2006.01) |
| ***A61M 15/06*** | (2006.01) |

(56) References Cited

FOREIGN PATENT DOCUMENTS

| | | | |
|---|---|---|---|
| CN | 207040889 | U | 2/2018 |
| CN | 109279172 | A | 1/2019 |
| CN | 110338465 | A | 10/2019 |
| CN | 209498584 | U | 10/2019 |
| CN | 111011933 | A | 4/2020 |
| CN | 111165878 | A | 5/2020 |
| CN | 210611013 | U | 5/2020 |
| CN | 111631437 | A | 9/2020 |
| CN | 111657548 | A | 9/2020 |
| CN | 214431782 | U | 10/2021 |
| WO | 2015/037925 | A1 | 3/2015 |

OTHER PUBLICATIONS

English machine translation of CN110338465A to Yi et al. entitled Ventilation Valve and Electronic Atomization Device; published Oct. 18, 2019; 19 pages; (Year: 2019).*

English machine translation of GB 2542011 A to Ian et al. entitled Electronic Vaporiser System; published Mar. 8, 2017; 190 pages. (Year: 2017).*

* cited by examiner

VAPORIZER AND ELECTRONIC VAPORIZATION DEVICE

CROSS-REFERENCE TO RELATED APPLICATIONS

This application is a 35 U.S.C. § 371 National Phase conversion of International (PCT) Patent Application No. PCT/CN2021/131272, filed on Nov. 17, 2021, which claims priority to Chinese Patent Application No. 202011340644.7, entitled "VAPORIZER AND ELECTRONIC VAPORIZATION DEVICE" and filed with the China National Intellectual Property Administration on Nov. 25, 2020, which is incorporated herein by reference in its entirety. The PCT International Patent Application was filed and published in Chinese.

TECHNICAL FIELD

Embodiments of this application relate to the field of electronic vaporization technologies, and in particular, to a vaporizer and an electronic vaporization device.

BACKGROUND

There are aerosol-providing articles, for example, electronic vaporization devices. The devices generally include e-liquid. The e-liquid is heated to be vaporized, to generate an inhalable vapor or aerosol. The e-liquid may include nicotine and/or a fragrance composite and/or an aerosol-generation article (for example, glycerol). In addition to the fragrance composite in the e-liquid, an existing electronic vaporization device generally includes a porous ceramic body that has a large amount of micropores inside and is configured to absorb and transfer the e-liquid, and a heating element is arranged on a surface of the porous ceramic body to heat and vaporize the absorbed e-liquid. The micropores in the porous body are used as channels for the e-liquid to infiltrate and flow to a vaporization surface, and also used as air exchange channels for air to enter a liquid storage cavity from the outside to serve as a supplement to maintain balance of the air pressure in the liquid storage cavity after the e-liquid in the liquid storage cavity is consumed, so that bubbles are generated in the porous ceramic body when the e-liquid is heated, vaporized, and consumed, and then the bubbles emerge from a liquid absorbing surface and then enter the liquid storage cavity.

For an existing e-cigarette device having the existing electronic vaporization device, as the e-liquid in the liquid storage cavity is consumed, the liquid storage cavity is gradually in a negative pressure state, preventing fluid transfer to a certain extent, so that the e-liquid is less conveyed to the vaporization surface through the micropore channels of the porous ceramic body for vaporization. Particularly, when the existing electronic vaporization device is in a use state of continuous inhaling, the air outside the liquid storage cavity is difficult to pass through the micropore channels of the porous ceramic body to enter the liquid storage cavity in a short time, slowing down the speed of transferring the e-liquid to the vaporization surface, and insufficient e-liquid supplied to the heating element causes an excessive temperature of the heating element, resulting in decomposition and volatilization of the e-liquid components to generate harmful substances such as formaldehyde.

SUMMARY

An embodiment of this application provides a vaporizer, configured to vaporize a liquid substrate to generate an aerosol for inhaling, including: a liquid storage cavity configured to store a liquid substrate; and further including:

- a heater, in fluid communication with the liquid storage cavity, and configured to absorb the liquid substrate and heat the liquid substrate to generate an aerosol;
- a sealer, at least partially sealing the liquid storage cavity;
- a holder, configured to support the sealer to locate the sealer between the holder and the liquid storage cavity; and
- a first air channel, providing a first flowing path for air to enter the liquid storage cavity, where the first air channel is at least partially defined by the holder, and has an air outlet end formed on a surface of the holder; and
- the sealer includes an end wall and a side wall extending from the end wall and at least partially surrounding the holder, the end wall is provided with a bent slit to define and form a suspended blocking part configured to seal the air outlet end, the blocking part includes a free end and a connection end configured to connect to other parts of the sealer, the connection end is more distant from an edge position of the end wall than the free end, and the edge position is a position in an outer edge of the end wall that is closer to the free end.

In the vaporizer, the free end of the blocking part is close to the edge position of the end wall of the sealer, and the connection end is more distant from the edge position of the end wall, so that in an assembly process, friction or deformation tension suffered by the edge position is separated by the slit defining the free end and has no impact on the connection end of the blocking part, thereby preventing the connection end from opening the first air channel due to deformation.

An embodiment of this application further provides a vaporizer, configured to vaporize a liquid substrate to generate an aerosol for inhaling, including: a liquid storage cavity configured to store a liquid substrate; and further including:

- a heater, in fluid communication with the liquid storage cavity, and configured to absorb the liquid substrate and heat the liquid substrate to generate an aerosol;
- a sealer, at least partially sealing the liquid storage cavity;
- a holder, configured to support the sealer to locate the sealer between the holder and the liquid storage cavity; and
- a first air channel, providing a first flowing path for air to enter the liquid storage cavity, where the first air channel is at least partially defined by the holder, and has an air outlet end formed on a surface of the holder;
- the sealer is provided with a blocking part configured to seal the air outlet end; and the blocking part has a free end away from a center of the sealer, and the free end is configured to bend or deform in response to a negative pressure change in the liquid storage cavity, to open the air outlet end.

The vaporizer can relieve the negative pressure in the liquid storage cavity, and the free end of the blocking part extends away from the center of the sealer, so that the first air channel is not opened due to deformation caused by friction in an assembly process.

In a preferred embodiment, the sealer includes a slit or groove partially surrounding the blocking part, and the blocking part is defined by the slit or groove.

In a preferred embodiment, the slit or groove is constructed to bend toward the center of the sealer.

In a preferred embodiment, the blocking part is constructed to extend along a cross section direction of the vaporizer.

In a preferred embodiment, a recessed structure is provided on a surface of the blocking part that is toward the holder, and the recessed structure is configured to reduce a thickness and strength of the blocking part, so that the blocking part is more susceptible to bending or deformation.

In a preferred embodiment, an inner diameter of the first air channel at least partially gradually decreases along a direction close to the air outlet end.

In a preferred embodiment, the inner diameter of the first air channel at least partially decreases in a step-shaped manner along the direction close to the air outlet end.

In a preferred embodiment, the holder is provided with a protruding edge surrounding the air outlet end of the first air channel, and the blocking part is constructed to abut the protruding edge, to seal the air outlet end.

In a preferred embodiment, the holder at least partially defines a second air channel, to provide a second flowing path for air to enter the liquid storage cavity, and a porous body material is arranged in the second air channel.

In a preferred embodiment, the sealer is provided with a through hole opposite to the second air channel, and air in the second air channel enters the liquid storage cavity through the through hole.

In a preferred embodiment, the vaporizer further includes:

an air inlet, where an outer wall of the holder is provided with a concave cavity in airflow communication with the air inlet, and an air inlet end of the second air channel is in communication with the concave cavity.

In a preferred embodiment, an air pressure at an air inlet end of the first air channel is the same as an atmospheric pressure.

Another embodiment of this application further provides a vaporizer, configured to vaporize a liquid substrate to generate an aerosol for inhaling, including: a liquid storage cavity configured to store a liquid substrate; and further including:

a heater, in fluid communication with the liquid storage cavity, and configured to absorb the liquid substrate and heat the liquid substrate to generate an aerosol;

a sealer, at least partially sealing the liquid storage cavity;

a holder, configured to support the sealer to locate the sealer between the holder and the liquid storage cavity; and an air channel, at least partially defined by the holder, and configured to provide a flowing path for air to enter the liquid storage cavity, where a porous body material is arranged in the air channel.

In a preferred embodiment, the sealer is provided with a through hole opposite to the air channel, and air in the air channel enters the liquid storage cavity through the through hole.

In a preferred embodiment, a pore size of the through hole is less than an inner diameter of the air channel.

In a preferred embodiment, the porous body material is located at a position close to an air outlet end of the air channel.

In a preferred embodiment, the vaporizer further includes:

an air inlet, where an outer wall of the holder is provided with a concave cavity in airflow communication with the air inlet, and an air inlet end of the air channel is in communication with the concave cavity.

In a preferred embodiment, an air pressure at an air inlet end of the air channel is the same as an atmospheric pressure.

In a preferred embodiment, the air channel includes a hole partially extending in the holder, and a groove partially located on an outer wall of the holder.

In the vaporizer, the air channel is always open, and the porous body material is arranged to ensure air flowing into the liquid storage cavity to serve as a supplement to relieve the negative pressure in the liquid storage cavity and prevent liquid from seeping out.

An embodiment of this application further provides an electronic vaporization device, including a vaporizer configured to vaporize a liquid substrate to generate an aerosol, and a power supply assembly configured to supply power to the vaporizer. The vaporizer includes the vaporizer described above.

BRIEF DESCRIPTION OF THE DRAWINGS

One or more embodiments are described by way of example with reference to the corresponding figures in the accompanying drawings, and the exemplary descriptions are not to be construed as limiting the embodiments. Elements/modules and steps in the accompanying drawings that have same reference numerals are represented as similar elements/modules and steps, and unless otherwise particularly stated, the figures in the accompanying drawings are not drawn to scale.

DETAILED DESCRIPTION

For ease of understanding of this application, this application is described in further detail below with reference to the accompanying drawings and specific implementations.

Figure 1:
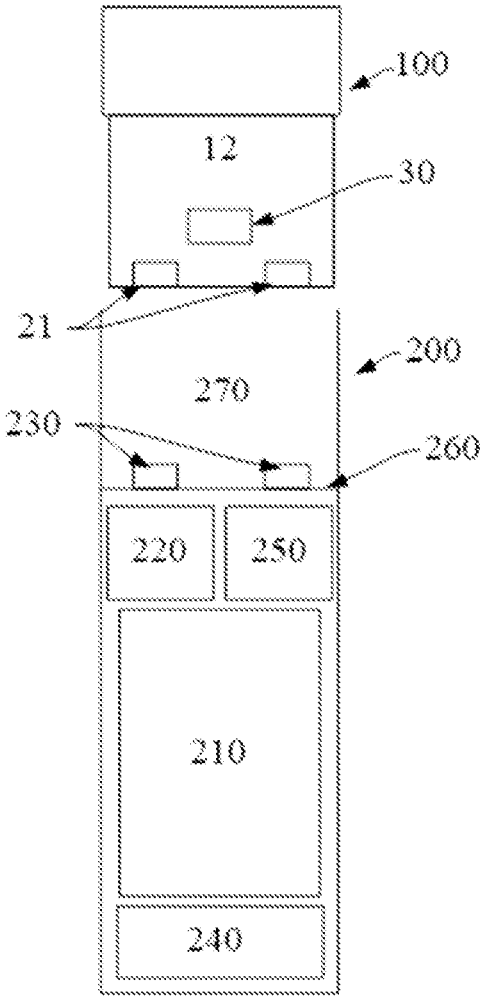
FIG. 1 is a schematic diagram of an electronic vaporization device according to an embodiment of this application.

An embodiment of this application provides an electronic vaporization device. referring to FIG. 1, a construction of the device includes: a vaporizer 100, configured to store a liquid substrate and vaporize the liquid substrate to generate an aerosol, and a power supply assembly 200, configured to supply power to the vaporizer 100.

In an optional embodiment, for example, as shown in FIG. 1, the power supply assembly 200 includes: a receiving cavity 270, arranged on an end along a longitudinal direction and configured to receive and accommodate at least a part of the vaporizer 100; and a first electrical contact 230, at least partially exposed on a surface of the receiving cavity 270, configured to be electrically connected to the vaporizer 100 to supply power to the vaporizer 100 when at least a part of the vaporizer 100 is received and accommodated in the power supply assembly 200.

According to the preferred embodiment shown in FIG. 1, a second electrical contact 21 is arranged on an end portion of the vaporizer 100 that is opposite to the power supply assembly 200 along the longitudinal direction, so that when the at least a part of the vaporizer 100 is received in the receiving cavity 270, the second electrical contact 21 becomes conductive through being in contact with and abutting the first electrical contact 230.

A seal member 260 is arranged in the power supply assembly 200, and at least a part of an internal space of the power supply assembly 200 is separated by the seal member 260 to form the receiving cavity 270. In the preferred embodiment shown in FIG. 1, the seal member 260 is configured to extend along a cross section direction of the power supply assembly 200, and is prepared by a flexible material, to prevent the liquid substrate seeping from the vaporizer 100 to the receiving cavity 270 from flowing to components such as a controller 220 and a sensor 250 inside the power supply assembly 200.

In the preferred embodiment shown in FIG. 1, the power supply assembly 200 further includes: a battery cell 210, close to another end relative to the receiving cavity 270 along the longitudinal direction for supplying power; and a controller 220, arranged between the battery cell 210 and an accommodating cavity, and operably guiding a current between the battery cell 210 and the first electrical contact 230.

The power supply assembly 200 includes a sensor 250, configured to sense an inhalation airflow generated by the vaporizer 100 during inhalation, so that the controller 220 controls, based on a detection signal of the sensor 250, the battery cell 210 to output a current to the vaporizer 100.

Further, in the preferred embodiment shown in FIG. 1, a charging interface 240 is arranged on another end of the power supply assembly 200 that is opposite to the receiving cavity 270, and is configured to charge the battery cell 210 through a connection with an external charging device.

Further, FIG. 2 to FIG. 5 show the structure of the vaporizer 100 in FIG. 1 according to a preferred embodiment. As shown in the figures, for a specific external construction, the vaporizer 100 includes:

- a main housing 10, roughly constructed into a hollow cylinder, and provided with an inhalation opening A located on a near end, where the main housing 10 is provided with an exposure located on a far end, making it convenient to assemble function components inside the main housing 10 through the exposure; and in use, the near end is used as an end for a user to inhale, and the far end is used as an end received in the receiving cavity 270; and
- an end cap 20, arranged on the far end, and configured to close the exposure of the main housing 10 that is close to the far end. The end cap 20 is prepared by using a ferromagnetic material such as stainless steel, so that after being received in the receiving cavity 270, the vaporizer 100 can be magnetically attached by a magnetic attaching element arranged on the power supply assembly 200, and the vaporizer 100 is stably received in the receiving cavity 270.

Figure 2:
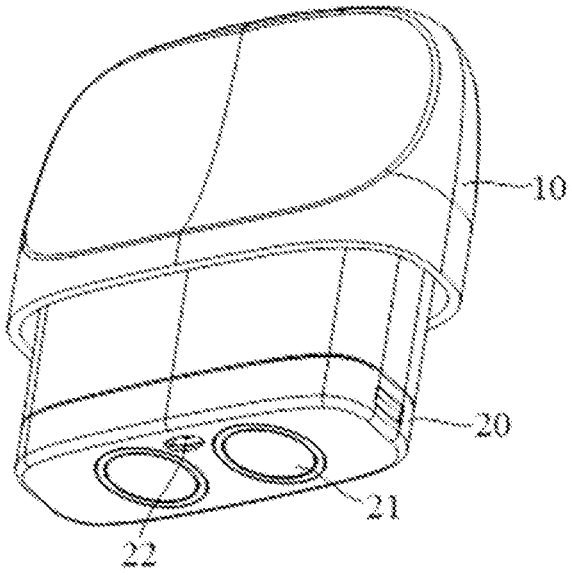
FIG. 2 is a schematic diagram of the vaporizer in FIG. 1 from an angle of view in an embodiment.

Further referring to FIG. 2, the second electrical contact 21 penetrates from outside of the end cap 20 into the main housing 10 and is at least partially exposed outside of the end cap 20, making it convenient to be conductively connected to the power supply assembly 200.

Further, in FIG. 2 to FIG. 5, an inner structure of the vaporizer 100 includes:

- an aerosol output pipe 11, formed at a center of the main housing 10 and extending along the longitudinal direction, and integrally prepared with the main housing 10 by using a mold, where an upper end of the aerosol output pipe 11 is in communication with the inhalation opening A, to output the aerosol generated inside the vaporizer 100 to the inhalation opening A; and
- a liquid storage cavity 12, defined and formed by a space between the aerosol output pipe 11 and an inner wall of the main housing 10, and configured to store the liquid substrate, where
- the heater 30 includes a liquid guide element 310 and a heating element 320, and the liquid guide element 310 is prepared by a material having capillary channels or pores, for example, a hard or porous material such as fiber cotton, a porous ceramic body, a fiberglass rope, porous ceramic, or porous glass. The liquid guide element 310 is in fluid communication with the liquid storage cavity 12 to absorb the liquid substrate. The liquid guide element 310 has a lower surface toward the end cap 20, and the lower surface is preferably a plane extending along a cross section of the main housing 10 and is used as a vaporization surface forming the heating element 320. The heating element 320 heats at least a part of the liquid substrate in the liquid guide element 310 to generate the aerosol, and the aerosol is released after effusing from the vaporization surface.

Figure 3:
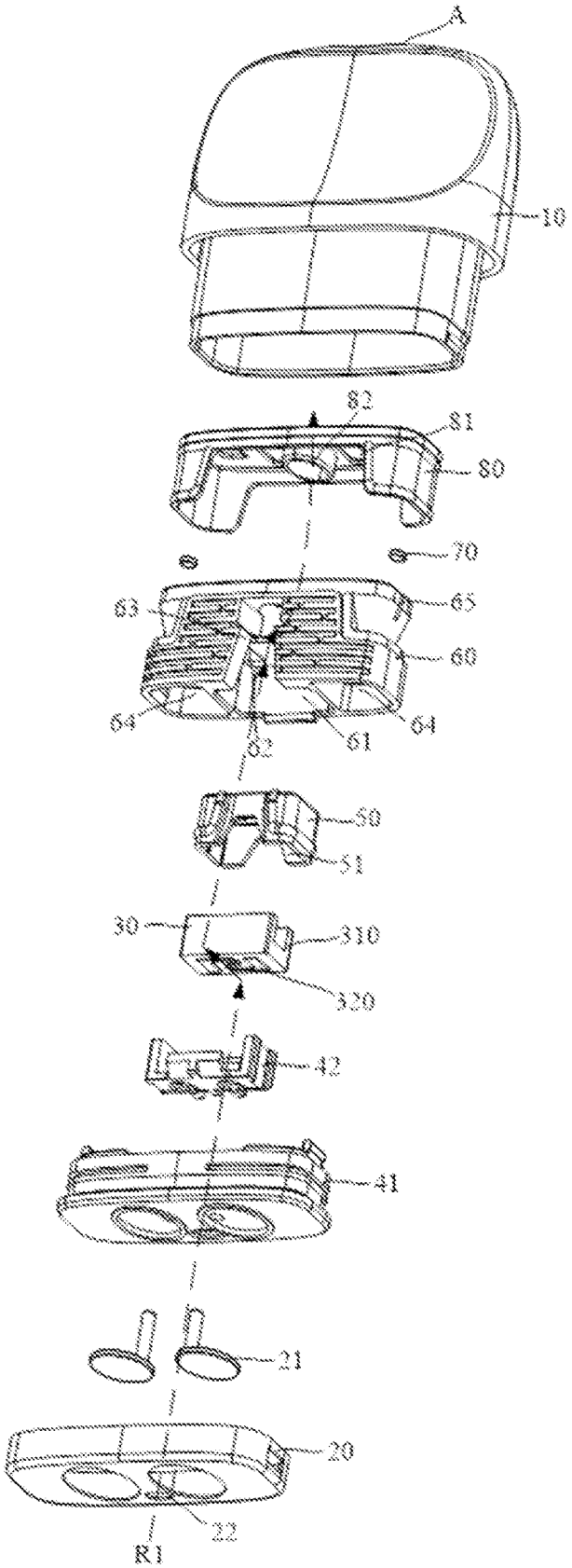
FIG. 3 is a schematic exploded diagram of each part of the vaporizer in FIG. 2 from an angle of view.

In a preferred embodiment shown in FIG. 3, the heating element 320 is formed on the vaporization surface of the liquid guide element 310 in a manner of mounting, printing, deposition, or the like. In some embodiments, the heating element 320 may be made of a material such as stainless steel, nickel chromium alloy, iron chromium aluminum alloy, or metal titanium. As shown in FIG. 2, the heating element 320 is a conductive trajectory in a winding or circuitous pattern.

Figure 4:
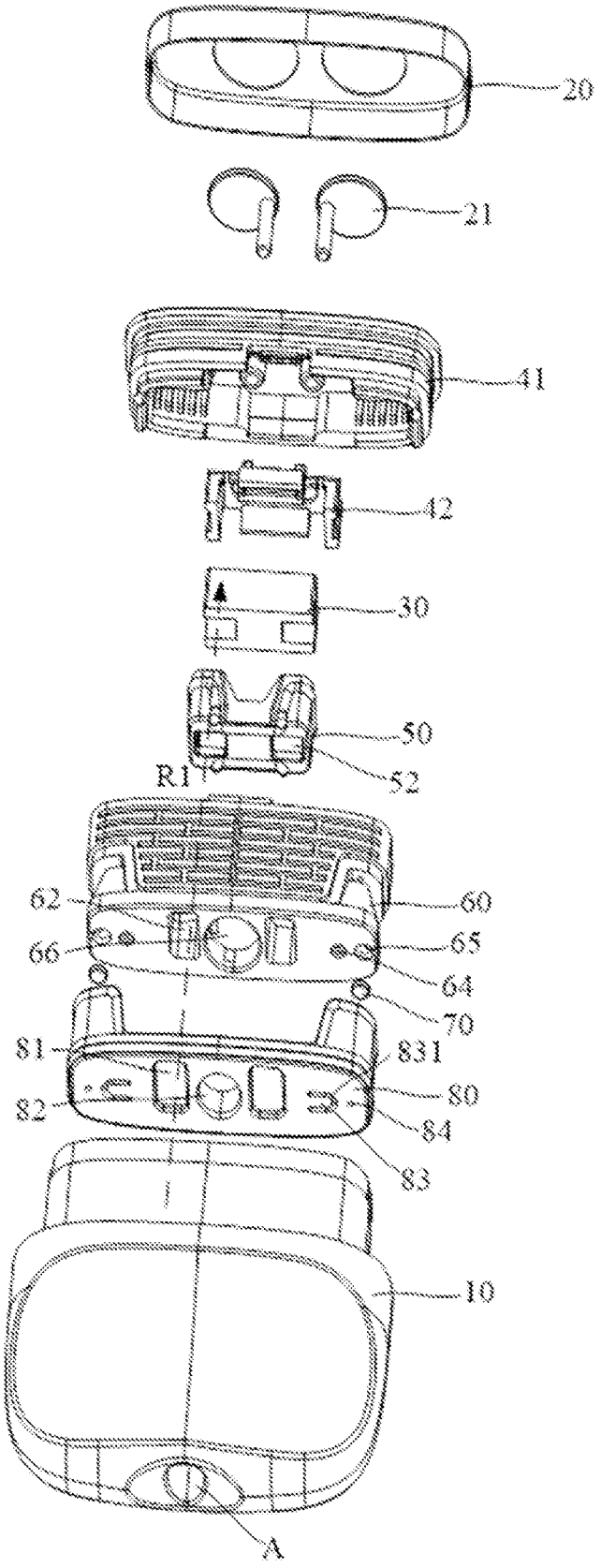
FIG. 4 is a schematic exploded diagram of each part of the vaporizer in FIG. 2 from another angle of view.

Further, as shown in FIG. 3 and FIG. 4, a support base 41 and a silicone bearing element 42 that is located in the support base 41 and is arranged opposite to the vaporization surface of the liquid guide element 310 are arranged between the heater 30 and the end cap 20. During implementation, the bearing element 42 and the vaporization surface of the liquid guide element 310 jointly define a vaporization chamber for accommodating the released aerosol. The bearing element 42 is opposite to the vaporization surface, to receive an aerosol condensate in the vaporization chamber and a liquid substrate effusing or seeping from the vaporization surface.

Further, in the preferred embodiment shown in FIG. 3 and FIG. 4, to stably support and assemble the heater 30, the main housing 10 is internally provided with:

- a silicone sleeve 50, accommodating and wrapping the liquid guide element 310;
- a rigid holder 60, configured to accommodate and support the silicone sleeve 50 and the liquid guide element 310; and
- a sealer 80, arranged to be close to the liquid storage cavity 12, configured to seal the liquid storage cavity 21 to prevent the liquid substrate from seeping out, and at least partially wrapping the rigid holder 60.

With the stable support of the liquid guide element 310, the silicone sleeve 50 has a first accommodating space 51, and the liquid guide element 310 is accommodated and supported in the first accommodating space 51; and the rigid holder 60 has a second accommodating space 61, and the silicone sleeve 50 and the liquid guide element 310 are entirely assembled in the second accommodating space 61.

Figure 5:
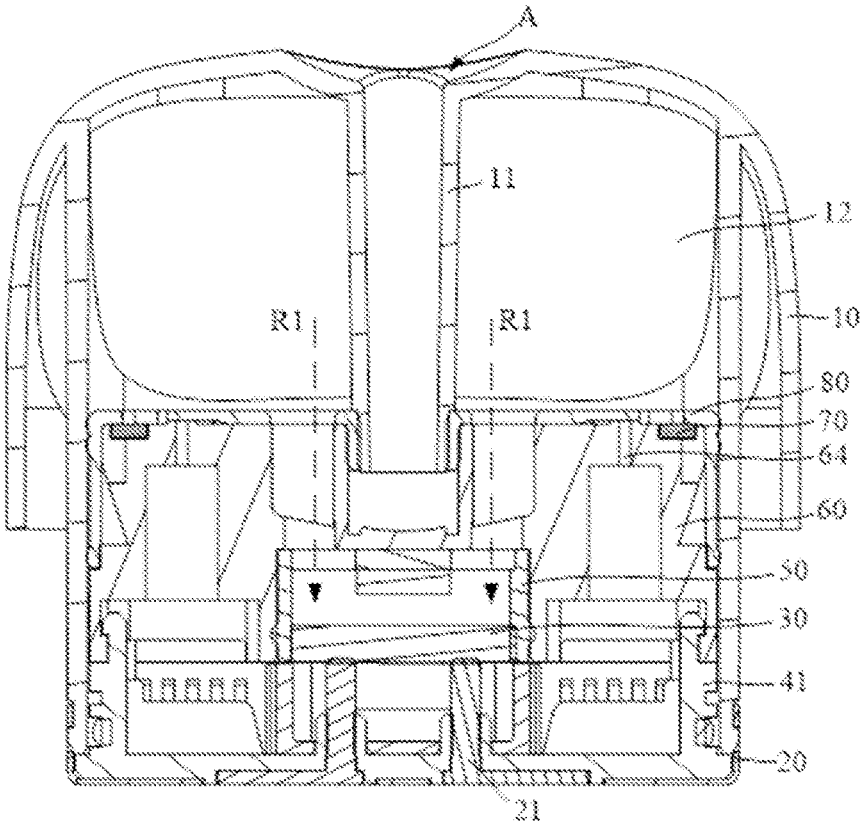
FIG. 5 is a schematic cross-sectional diagram of the vaporizer in FIG. 2 along a width direction.

Further referring to FIG. 3 to FIG. 5, to match a structure design of forming a liquid flowing channel, the sealer 80 is provided with a first liquid guide hole 81, the rigid holder 60 is provided with a second liquid guide hole 62, and the silicone sleeve 50 is provided with a third liquid guide hole 52. In use, after successively passing through the first liquid guide hole 81, the second liquid guide hole 62, and the third liquid guide hole 52, the liquid substrate in the liquid storage cavity 12 flows to the liquid guide element 310 and is absorbed, as shown by an arrow R1 in FIG. 4 and FIG. 5, and finally is vaporized on the vaporization surface of the liquid guide element 310 and released into the vaporization chamber.

Further referring to FIG. 3, to match a structure of forming an inhalation airflow, the vaporization chamber defined by the silicone bearing element 42 and the liquid guide element 310 is in communication with an air inlet hole 22 provided on the end cap 20. In addition, the sealer 80 is provided with a first insertion hole 82 for inserting the aerosol output pipe 11. The rigid holder 60 is provided with a second insertion hole 66 opposite to the first insertion hole 82 and an output channel 63 located on a side of a thickness direction. An airflow path during inhalation is shown by an arrow R2 in FIG. 3. The external air enters the vaporization chamber through the air inlet hole 22 on the end cap 20, and then carries the generated aerosol to be outputted from the output channel 63 to the aerosol output pipe 11 connected to the second insertion hole 66, until it is inhaled from the inhalation opening A.

Figure 6:
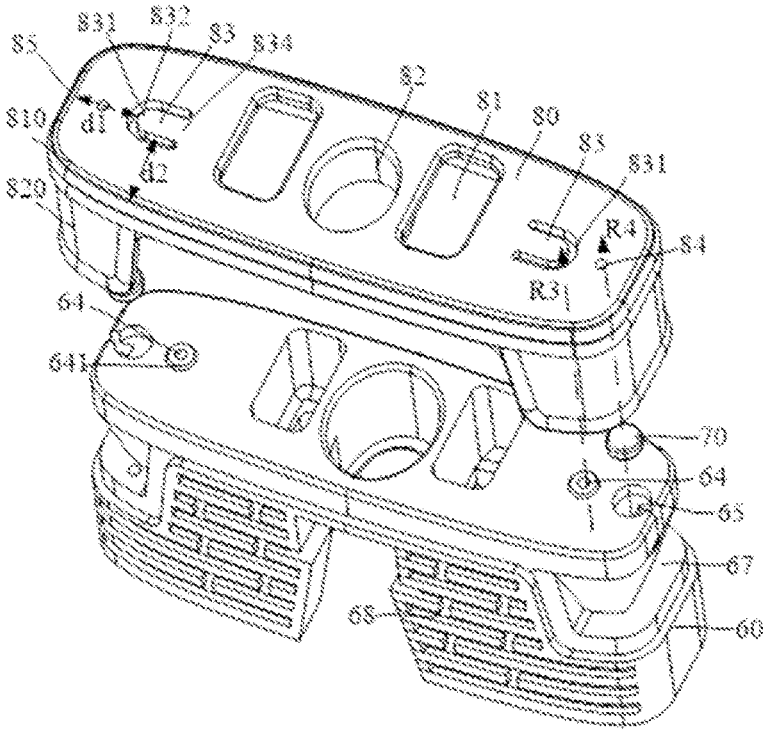
FIG. 6 is a schematic exploded diagram of a rigid holder and a sealer in FIG. 5 from another angle of view.

Further referring to FIG. 4 and FIG. 6, to supplement air to the liquid storage cavity 12 to relieve the negative pressure in the liquid storage cavity 12 as much as possible, the rigid holder 60 is provided with a first air channel 64 and a second air channel 65. In use, the first air channel 64 and the second air channel 65 are both configured to supplement air to the liquid storage cavity 12.

The first air channel 64 penetrates the rigid holder 60 along the longitudinal direction, and the second air channel 65 is formed by a space such as a groove or an opening on an outer side wall of the rigid holder 60 along a width direction.

In another optional embodiment, the first air channel 64 and the second air channel 65 may not be provided simultaneously, and only one of the two channels may be implemented.

Figure 7:
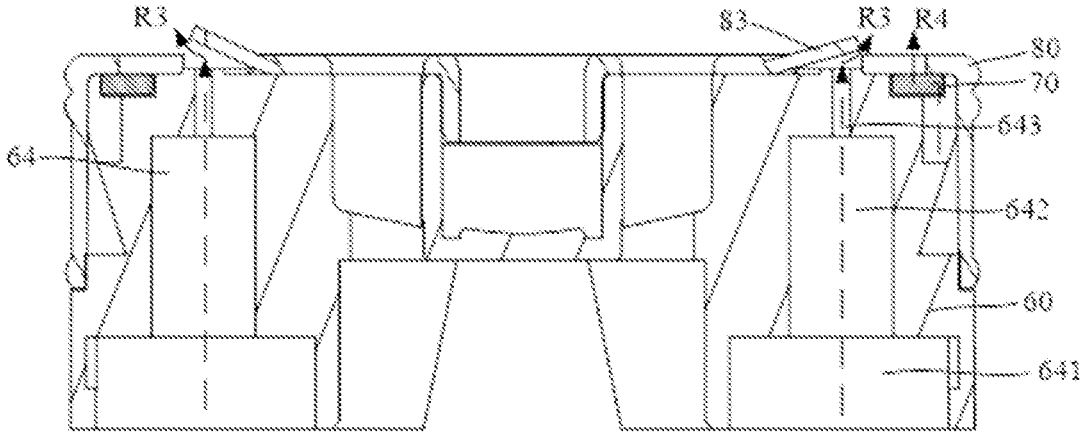
FIG. 7 is a schematic cross-sectional diagram of the sealer in FIG. 6 opening a first air channel.

To match the foregoing structure, the sealer 80 is provided with a blocking part 83 configured to block and seal an air outlet end of the first air channel 64. As shown in FIG. 6, the blocking part 83 is formed by surrounding a U-shaped groove or slit 831, so that the blocking part 83 and other parts of the sealer 80 are suspended. Usually, the blocking part 83 blocks the air outlet end of the first air channel 64. However, when the increase of the negative pressure in the liquid storage cavity 12 exceeds a threshold, the blocking part 83 can bend or warp into the liquid storage cavity 12 in response to the negative pressure change, as shown in FIG. 7, so that the air outlet end of the first air channel 64 is opened, and the external air enters the liquid storage cavity 12 to relieve the negative pressure.

Further referring to an embodiment shown in FIG. 6, the blocking part 83 of the sealer 80 is constructed to extend along the width direction. Certainly, in an optional embodiment, the blocking part 83 may be at an included angle with the width direction. In a preferred embodiment, the included angle may range from −90 to 90 degrees.

Further referring to the embodiment shown in FIG. 6, the sealer 80 is in a shape with an end wall 810, and a side wall 820 extending from the end wall 810 and wrapping the holder 60. The blocking part 83 is formed on the end wall 810. The sealer 80 has an edge position 85 closest to a front free end 831 of the blocking part 83. In the sealer 80 with the shape and size shown in FIG. 6, the edge position 85 is an edge position along the width direction that is close to the free end 831. A distance d1 between the edge position 85 and the free end is 4.2 mm. A distance d2 between a side edge of the sealer 80 and the blocking part 83 along a thickness direction of the vaporizer 100 is 4.8 mm. A connection end 834 of the blocking part 83 that is away from the free end 831 is more distant from the edge position so that in an assembly process, friction or deformation tension suffered by the edge position is separated by the slit defining the free end 831 and has no impact on the connection end 834 of the blocking part 83, thereby preventing the connection end 834 from opening the first air channel 64 due to deformation.

Further as shown in FIG. 6, the blocking part 83 has a free end 832, and the free end 832 is defined by the U-shaped groove or slit 831. The formed free end 832 can deform such as bend or warp relative to the sealer 80. In addition, the U-shaped groove or slit 831 forming the blocking part 83 extends along a width direction of the sealer 80, and the blocking part 83 also extends along the width direction of the sealer 80. In addition, the U-shaped groove or slit 831 bends toward the center of the sealer 80. Therefore, in an assembly process, when the sealer 80 is assembled from an exposure end of the main housing 10 upward into the main housing 10, and an edge of the sealer 80 along the width direction rubs against the inner wall of the main housing 10, because the blocking part 83 is substantially separated from the edge of the sealer 80, the blocking part 83 does not bend or warp as the edge part rubs against the inner wall of the main housing 10, and the blocking part 83 is maintained to substantially bond or seal a port of the first air channel 64 after assembly.

The sealer 80 is provided with a through hole 84 opposite to an air outlet end of the second air channel 65, so that air in the second air channel 65 enters the liquid storage cavity 12 through the through hole 84. To prevent the liquid substrate in the liquid storage cavity 12 from directly massively flowing out from the through hole 84 into the second air channel 65, a porous body material 70 is filled inside the second air channel 65 that is close to the air outlet end. During implementation, the porous body material 70 is preferably flexible, and may be made of sponge, fiber cotton, porous foam, or the like. The porous body material 70 filled in the second air channel 65 can lock the seeping liquid substrate.

During implementation, in the vaporizer 100 in a normal state, a part of the liquid substrate may be absorbed into and infiltrate the porous body material 70, and does not seep out due to the negative pressure in the liquid storage cavity 12. When the negative pressure in the liquid storage cavity 12 further increases in an inhalation process, the liquid substrate absorbed by the porous body material 70 reflows into the liquid storage cavity 12 with the external air.

In addition, in the preferred embodiment shown in FIG. 6, an inner diameter of the air outlet end of the second air channel 65 is greater than an inner diameter of the first air channel 64.

An inner diameter of the through hole 84 is about 3-5 mm that is less than the inner diameter of the second air channel 65, thereby preventing the liquid substrate from massively seeping into the second air channel 65. In addition, in the preferred embodiment shown in FIG. 6, the second air channel 65 is a groove that is close to an edge of a width direction of the rigid holder 60, and is partially formed on the side wall of the rigid holder 60.

Referring to FIG. 6, side walls of two sides of the rigid holder 60 are provided with a recessed structure 67 at least partially surrounding the rigid holder 60 along a circumferential direction, and the second air channel 65 is in communication with the recessed structure 67 to be in communication with the external air. Further, the side wall of the rigid holder 60 is provided with several capillary grooves 68 in airflow communication with the vaporization chamber and the recessed structure 67, so that the external air enters the recessed structure 67 through the capillary grooves 68. In addition, the capillary grooves 68 can further absorb and maintain, by a capillary action, aerosol condensate generated in the vaporization chamber.

In a more preferred embodiment, air inlet ends of the first air channel 64 and the second air channel 65 are directly in communication with external atmosphere through the rigid holder 60 or the through hole on the wall of the main housing 10, so that pressures of the air inlet ends are the same as the atmospheric pressure, and the external air directly enters into the liquid storage cavity 12 through the air inlet ends when the negative pressure in the liquid storage cavity 12 is excessive.

Further referring to FIG. 7, the inner diameter of the first air channel 64 is changing, for example, gradually changing or gradually changing in a step-shaped manner. Preferably, the inner diameter gradually decreases along a direction close to the liquid storage cavity 12. For example, in FIG. 7, the first air channel 64 includes a first part 641, a second part 642, and a third part 643 that are in different inner diameter sizes in sequence along the direction close to the liquid storage cavity 12, and inner diameters of the first part 641, the second part 642, and the third part 643 gradually decrease.

As shown in FIG. 6, a surface of the rigid holder 60 is further provided with a protruding edge 641 surrounding the port of the first air channel 64, and the blocking part 83 abuts and is bonded on the protruding edge 641 after assembly.

Figure 8:
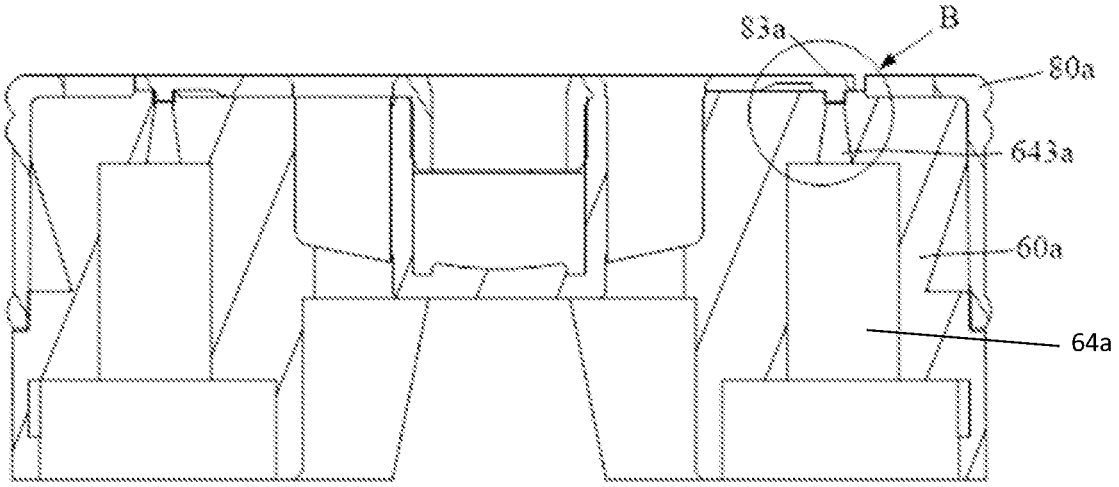
FIG. 8 is a schematic cross-sectional diagram of a sealer sealing a first air channel according to another embodiment.
Figure 9:
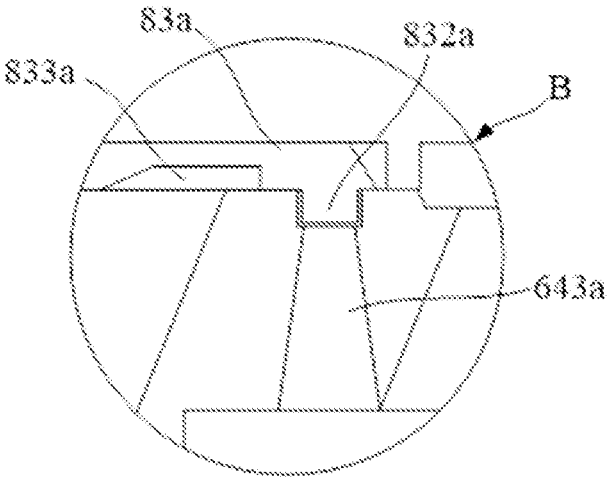
FIG. 9 is a schematic enlarged diagram of portion B in FIG. 8.

FIG. 8 and FIG. 9 are schematic structural diagrams of a sealer 80*a* sealing a first air channel 60*a* of a rigid holder 60*a* according to another embodiment.

An inner diameter of a third part 643*a* of the first air channel 60*a* gradually decreases in a cone-shaped manner, and a notch is provided on an air outlet end. A blocking part 83 corresponding to the sealer 80*a* is provided with a protrusion 832*a* that can extend into the notch, so that the air outlet end of the third part 643*a* is sealed by the protrusion 832*a*.

In addition, to further facilitate bending deformation of the blocking part 83, a recessed structure 833*a* is provided on a surface of the blocking part 83*a* that is toward the rigid holder 60*a*, which is conducive to reduce a thickness and strength of the blocking part 83, so that the blocking part 83 can deform such as bend or warp in response to a negative pressure change more sensitively.

It should be noted that, the specification and the accompanying drawings of this application provide preferred embodiments of this application, but is not limited to the embodiments described in this specification. Further, a person of ordinary skill in the art may make improvements or modifications according to the foregoing description, and all of the improvements and modifications should all fall within the protection scope of the attached claims of this application.

What is claimed is:

1. A vaporizer, configured to vaporize a liquid substrate to generate an aerosol for inhaling, comprising: a liquid storage cavity configured to store the liquid substrate; and further comprising:

a heater, in fluid communication with the liquid storage cavity, and configured to heat the liquid substrate to generate the aerosol;

a sealer, at least partially sealing the liquid storage cavity;

a holder, configured to support the sealer to locate the sealer between the holder and the liquid storage cavity; and a first air channel, providing a first flowing path for air to enter the liquid storage cavity, wherein the first air channel is at least partially defined by the holder, and has an air outlet end formed on a surface of the holder;

wherein:

the sealer comprises a main part and a blocking part configured to seal the air outlet end;

the blocking part extends from the main part, the blocking part has a connecting end that is connected to the main part and a free end away from a center of the sealer, the free end is farther away from a center of the sealer than the connecting end, and the free end is configured to bend or deform in response to a negative pressure change in the liquid storage cavity, to open the air outlet end.

2. The vaporizer according to claim 1, wherein the sealer comprises a slit or groove partially surrounding the blocking part, and the blocking part is defined by the slit or the groove.

3. The vaporizer according to claim 2, wherein the slit or groove is constructed to bend toward the center of the sealer.

4. The vaporizer according to claim 1, wherein the blocking part is constructed to extend along a cross section direction of the vaporizer.

5. The vaporizer according to claim 1, wherein an inner diameter of the first air channel at least partially gradually decreases along a direction pointing toward the air outlet end.

6. The vaporizer according to claim 5, wherein the inner diameter of the first air channel at least partially decreases in a step-shaped manner along the direction pointing toward the air outlet end.

7. The vaporizer according to claim 1, wherein the holder is provided with a protruding edge surrounding the air outlet end of the first air channel, and the blocking part is constructed to abut the protruding edge, to seal the air outlet end.

8. The vaporizer according to claim 1, wherein the holder at least partially defines a second air channel, to provide a second flowing path for air to enter the liquid storage cavity, and a porous body material is arranged in the second air channel.

9. The vaporizer according to claim 8, wherein the sealer is provided with a through hole opposite to the second air channel, and the air in the second air channel enters the liquid storage cavity through the through hole.

10. The vaporizer according to claim 9, further comprising:

an air inlet, wherein:

an outer wall of the holder is provided with a concave cavity in airflow communication with the air inlet, and an air inlet end of the second air channel is in communication with the concave cavity.

11. The vaporizer according to claim 1, wherein an air pressure at an air inlet end of the first air channel is the same as an atmospheric pressure.

12. A vaporizer, configured to vaporize a liquid substrate to generate an aerosol for inhaling, comprising: a liquid storage cavity configured to store the liquid substrate; and further comprising:

a heater, in fluid communication with the liquid storage cavity, and configured to heat the liquid substrate to generate the aerosol;

a sealer, at least partially sealing the liquid storage cavity;

a holder, configured to support the sealer to locate the sealer between the holder and the liquid storage cavity; and a first air channel, providing a first flowing path for air to enter the liquid storage cavity, wherein the first air channel is at least partially defined by the holder, and has an air outlet end formed on a surface of the holder; and the sealer comprises an end wall and a side wall extending from the end wall and at least partially surrounding the holder, the end wall is provided with a bent slit to define and form a suspended blocking part configured to seal the air outlet end, the blocking part comprises a free end and a connection end configured to connect to other parts of the sealer, the connection end is more distant from an edge position of the end wall than the free end, and the edge position is a position in an outer edge of the end wall that is closer to the free end.

13. A vaporizer, configured to vaporize a liquid substrate to generate an aerosol for inhaling, comprising: a liquid storage cavity configured to store the liquid substrate; and further comprising:

a heater, in fluid communication with the liquid storage cavity, and configured to heat the liquid substrate to generate the aerosol;

a sealer, at least partially sealing the liquid storage cavity;

a holder, configured to support the sealer to locate the sealer between the holder and the liquid storage cavity; and an air channel, at least partially defined by the holder, and configured to provide a flowing path for air to enter the liquid storage cavity, wherein a porous body material is arranged in the air channel;

wherein:

the sealer comprises a main part and a blocking part configured to seal the air outlet end;

the blocking part extends from the main part, the blocking part has a connecting end that is connected to the main part and a free end away from a center of the sealer, the free end is farther away from a center of the sealer than the connecting end, and the free end is configured to bend or deform in response to a negative pressure change in the liquid storage cavity, to open the air outlet end.

14. The vaporizer according to claim 13, wherein the sealer is provided with a through hole opposite to the air channel, and air in the air channel enters the liquid storage cavity through the through hole.

15. The vaporizer according to claim 14, wherein a pore diameter of the through hole is less than an inner diameter of the air channel.

16. The vaporizer according to claim 13, wherein the porous body material is located at a position next to an air outlet end of the air channel.

17. The vaporizer according to claim 13, further comprising:

an air inlet, wherein:

an outer wall of the holder is provided with a concave cavity in airflow communication with the air inlet, and an air inlet end of the air channel is in communication with the concave cavity.

18. The vaporizer according to claim 13, wherein an air pressure at an air inlet end of the air channel is the same as an atmospheric pressure.

19. The vaporizer according to claim 13, wherein the air channel comprises a hole partially extending in the holder, and a groove partially located on an outer wall of the holder.

20. An electronic vaporization device, comprising the vaporizer according to claim 1, and a power supply assembly configured to supply power to the vaporizer.

* * * * *